US011162339B2

(12) United States Patent
Lastra Melo et al.

(10) Patent No.: US 11,162,339 B2
(45) Date of Patent: Nov. 2, 2021

(54) QUICK CONNECT SYSTEM FOR DOWNHOLE ESP COMPONENTS

(71) Applicant: Saudi Arabian Oil Company, Dhahran (SA)

(72) Inventors: Rafael Adolfo Lastra Melo, Dhahran (SA); Faris Hasan Tulbah, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/807,426

(22) Filed: Mar. 3, 2020

(65) Prior Publication Data

US 2021/0277756 A1 Sep. 9, 2021

(51) Int. Cl.
*E21B 33/038* (2006.01)
*E21B 17/01* (2006.01)
*E21B 43/12* (2006.01)

(52) U.S. Cl.
CPC ..... *E21B 43/128* (2013.01)

(58) Field of Classification Search
CPC ..... E21B 33/038; E21B 33/076; E21B 17/01; E21B 33/043; E21B 33/035; E21B 43/128
USPC ..... 166/338, 339, 340, 341, 344, 345, 348, 166/351, 360, 377, 378, 367, 355, 359
See application file for complete search history.

(56) References Cited

U.S. PATENT DOCUMENTS 3,032,125 A * 5/1962 Hiser ..... E21B 17/01 175/7
4,114,928 A 9/1978 Lochte
4,347,012 A * 8/1982 Glidden ..... B63B 21/50 114/230.2
5,427,178 A * 6/1995 Bland ..... E21B 33/0415 166/78.1
5,582,438 A * 12/1996 Wilkins ..... E21B 33/0355 137/595
6,915,686 B2 7/2005 Baustad
7,191,840 B2 * 3/2007 Pietras ..... E21B 19/00 166/380
7,314,084 B2 1/2008 Rodrigues et al.
7,836,950 B2 11/2010 Vail, III et al.
7,958,938 B2 6/2011 Crossley et al.
8,607,877 B2 12/2013 Rodrigues
9,631,438 B2 * 4/2017 McKay ..... E21B 33/038
(Continued)

FOREIGN PATENT DOCUMENTS

WO WO-2006/053434 A1 5/2006
WO WO-2008/007970 A1 1/2008
WO WO-2012/156751 A2 11/2012

OTHER PUBLICATIONS

International Search Report for PCT/IB2020/053560, 5 pages (dated Oct. 12, 2020).
(Continued)

*Primary Examiner* — Edwin J Toledo-Duran
(74) *Attorney, Agent, or Firm* — Choate, Hall & Stewart LLP; Charles E. Lyon; Peter A. Flynn

(57) ABSTRACT

A quick connect system includes: a female component including: a center bore longitudinally disposed therethrough; a tooth recess disposed around an interior circumference of the center bore; and teeth circumferentially disposed within the tooth recess. The system also includes a male component including at least one cylindrical portion disposed within the center bore. The teeth engage the cylindrical portion.

19 Claims, 6 Drawing Sheets

(56) References Cited

U.S. PATENT DOCUMENTS

| | | | | |
|---|---|---|---|---|
| 9,835,001 | B2 | 12/2017 | Watt et al. | |
| 2006/0196668 | A1 | 9/2006 | Burge et al. | |
| 2013/0062050 | A1 | 3/2013 | Head | |
| 2013/0098632 | A1* | 4/2013 | Wetzel | E21B 19/16 166/373 |
| 2014/0144648 | A1* | 5/2014 | McKay | E21B 33/038 166/367 |
| 2018/0128058 | A1* | 5/2018 | Hatherall | E21B 17/046 |
| 2018/0163491 | A1* | 6/2018 | Nguyen | E21B 33/04 |
| 2018/0171733 | A1* | 6/2018 | Nguyen | E21B 23/01 |
| 2018/0283124 | A1 | 10/2018 | Hosie et al. | |
| 2019/0136642 | A1* | 5/2019 | Persent | E21B 17/085 |

OTHER PUBLICATIONS

Written Opinion for PCT/IB2020/053560, 8 pages (dated Oct. 12, 2020).

Bybee, K., Through-Tubing-Conveyed ESP Replacement—Live Well Intervention, SPE International (2009), <https://search.spe.org/i2kweb/SPE/doc/onepetro:FDD5B991/>. Retrieved on Sep. 4, 2020.

* cited by examiner

QUICK CONNECT SYSTEM FOR DOWNHOLE ESP COMPONENTS

FIELD

The subject matter described herein relates to apparatuses, systems, and methods for making and breaking connections between components of electric submersible pumps (ESPs).

BACKGROUND

Current standard electrical submersible pump (ESP) technology requires that the connection between two ESP components is made using bolted flanges. This type of connection is typically performed at the wellsite, may require considerable time, and may be susceptible to human errors. In addition, this type of connection technology does not allow the deployment and automatic connection of individual ESP components downhole, as required in alternate deployment applications, for example, those deployed in live well operations.

Currently, when an ESP requires replacement or maintenance, the well needs to be killed (that is, taken out of service and injected with brine to prevent the well from flowing naturally) and the ESP must be assembled at the well surface due to the constraints of the lubricator, which allows tools and components to be placed within the wellbore while maintaining pressure within the wellbore. Fully assembled ESPs are too long to fit inside the lubricator. As a result, wells need to be taken out of service, which hinders work-site productivity and production. In addition, pumping fluids downhole to kill the well may damage the well, and in turn may lead to costly repairs and further impacts on the productivity of the well.

SUMMARY OF THE INVENTION

The present disclosed embodiments include apparatuses, systems, and methods for making and breaking connections between downhole electrical submersible pump (ESP) components using male and female quick connect components that can be retro-fitted to existing ESP components. The quick connect apparatus of the present disclosed embodiments may attach two components to two different ESP parts. The first ESP part may be fitted with the female component and may be lowered downhole first. The female component may be equipped with grips, teeth, or claws that are able to tightly hold the male component whenever it lowers into the female component (for example, within a borehole). The second ESP part may be fitted with the male component and may be lowered downhole second. The male component may also be equipped with a disengagement sleeve in order for it to disengage when needed. In one or more embodiments, the male component may be lowered downhole first while the female component may be lower downhole second such that the male and female components are inverted. The quick connect system may also be used to mate (or connect) other components such as artificial lift equipment, cavity pumps, beam pumps, gas lift mandrels, packers, downhole sensors, tubing, and tools, as well as other components.

In one aspect, the present invention is directed to a quick connect system including: a female component including: a center bore longitudinally disposed therethrough; a tooth recess disposed around an interior circumference of the center bore; and teeth circumferentially disposed within the tooth recess; and a male component comprising at least one cylindrical portion disposed within the center bore, where the teeth engage the at least one cylindrical portion.

In some embodiments, the system is deployed within a downhole environment at a wellsite.

In some embodiments, the teeth include a plurality of first teeth and a plurality of second teeth, where the first teeth and the second teeth are alternatingly arranged within the tooth recess.

In some embodiments, each first tooth includes a doublet including a first doublet tooth and a second doublet tooth.

In some embodiments, the system includes the first doublet tooth and the second doublet tooth each include a longitudinally aligned edge.

In some embodiments, the first doublet tooth and the second doublet tooth are oriented at a first angle relative to each other, and the first angle is from about one (1) degree to about sixty (60) degrees.

In some embodiments, each second tooth includes a circumferential edge.

In some embodiments, the cylindrical portion includes an outer sleeve, where the outer sleeve includes a plurality of engagement features disposed around an outer circumference of the outer sleeve, the engagement features interfacing with the plurality of first teeth and the plurality of second teeth.

In some embodiments, the system includes at least one O-ring disposed within at least one O-ring recess circumferentially disposed around the interior circumference of the center bore.

In some embodiments, the O-ring includes: a first O-ring longitudinally spaced from the tooth recess; and a second O-ring longitudinally spaced from the tooth recess and disposed at an opposite longitudinal side of the tooth recess from the first O-ring.

In some embodiments, the system includes an inner sleeve concentrically disposed within the outer sleeve, the inner sleeve monolithic with a main body of the male component; and a shear pin coupled to each of the inner sleeve and the outer sleeve, the shear pin disposed within at least one hole disposed within each of the inner sleeve and the outer sleeve. The female component includes a first flange at a first longitudinal end, the first flange including at least one bolt hole disposed therethrough; and the male component including a second flange at a second longitudinal end, the second flange including at least one bolt hole disposed therethrough, where a longitudinal over-pull applied to the second flange causes the shear pin to shear off, thereby decoupling the outer sleeve from the inner sleeve.

In some embodiments, the plurality of engagement features includes: a plurality of first notches aligned in one or more circumferential rows around the outer circumference of the outer sleeve; a plurality of second notches aligned in one or more circumferential rows around the outer circumference of the outer sleeve, the plurality of second notches alternating with the plurality of first notches; at least one longitudinal gap separating the one or more circumferential rows; and at least one circumferential gap separating each first notch from an adjacent second notch, where the teeth and the plurality of engagement features prevent relative longitudinal and circumferential movement between the outer sleeve and the female component.

In some embodiments, each first tooth of the plurality of first teeth includes a doublet including a first doublet tooth and a second doublet tooth, where the first doublet tooth and the second doublet tooth each include a longitudinally aligned edge, where the first doublet tooth and the second doublet tooth are oriented at a first angle relative to each other, and where the first angle is from about one (1) degree to about sixty (60) degrees.

In another aspect, the present invention is directed to a quick connect system for an electric submersible pump (ESP) including: a female component including a first flange at one longitudinal end, the first flange including at least one bolt hole disposed therethrough, the female component further including: a center bore longitudinally disposed therethrough; a tooth recess disposed around an interior circumference of the center bore; and teeth circumferentially disposed within the tooth recess; a male component including a second flange at one longitudinal end, the second flange comprising at least one bolt hole disposed therethrough, the male component comprising at least one cylindrical portion disposed within the center bore, where the teeth engage the cylindrical portion.

In some embodiments, the system includes a first ESP component coupled to the female component via the first flange; a second ESP component coupled to the male component via the second flange; and a mechanical coupling concentrically disposed within the female component and the male component, where the mechanical coupling couples the first ESP component to the second ESP component.

In another aspect, the present invention is directed to a method of assembling a system in a downhole environment including: providing a female component in a downhole environment, the female component coupled to a first component of the system, the female component including a center bore longitudinally disposed therethrough, the female component including teeth disposed within an interior surface of the female component; deploying a male component into the downhole environment via at least one lubricator disposed in a borehole, the male component including a cylinder portion; and inserting the cylinder portion into the center bore, thereby causing the teeth to engage the cylinder portion.

In some embodiments, the method includes coupling a second component of the system to the male component prior to deploying the male component in the downhole environment.

In some embodiments, the method includes exerting a longitudinal over-pull force on the male component, where the cylinder portion is coupled to an inner sleeve extending from a main body of the male component via at least one shear pin, and where the shear pin shears off as a result of the longitudinal over-pull force, thereby decoupling the cylinder portion from the male component.

In some embodiments, the method includes fishing the male component out of the downhole environment after decoupling the cylinder portion from the male component.

In some embodiments, the method includes fishing both the female component and the male component out of the downhole environment; and engaging one or more reset bolts, the one or more reset bolts causing the teeth to disengage the cylinder portion, thereby decoupling the male component from the female component.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which.

DESCRIPTION OF CERTAIN EMBODIMENTS OF THE INVENTION

Figure 1:
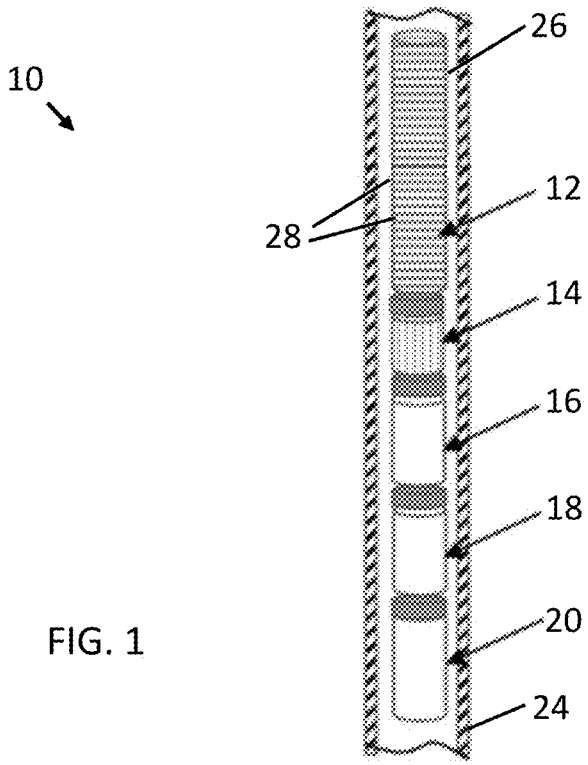
FIG. 1 illustrates a side view of an electrical submersible pump assembly, according to aspects of the present disclosed embodiments.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present disclosed embodiments include apparatuses and systems for making and breaking quick connect couplings and connections in a downhole environment while the oil or gas well in which the downhole environment is disposed may be active and/or live. The present disclosed embodiments include inserting a cylindrical portion of a male component into a center bore of a female component in which the cylindrical portion may be engaged by teeth disposed within the interior of the female component. Each of the male and female components may be coupled to at least one component of a downhole assembly such as an electrical submersible pump (ESP) or drilling string. A mechanical coupling concentrically disposed through both the male and female components may be used to couple adjacent components of the downhole assembly.

FIG. 1 illustrates a schematic of an electric submersible pump (ESP) system 10 including a pump module 12 disposed above a pump intake 14. Fluids such as liquid hydrocarbons, gaseous hydrocarbons, water, water vapor, and other fluids may enter the pump assembly 10 via the pump intake 14, which may include one or more filters (not shown) to prevent sand, dirt, and other debris from entering the pump assembly 10. The pump module 12 may be coupled fluidly downstream of the pump intake 14 (but physically above the pump intake 14 in the embodiment of FIG. 1), and may include a series of centrifugal impellers 28 and diffusers (not shown), each impeller 28 including one or more vanes (not shown). As such, the pump module may include a generally cylindrical shape or form factor. A pump protector 16 may be disposed below the pump intake 14 and may include seals, oil sumps, fluid pressurization features, thermal management features, and other features (such as electrical insulation) that help to protect the pump assembly 10 and components thereof from environmental hazards, and other potentially harmful conditions. An electrical motor 18 may be disposed below the pump protector 16 and may be used to mechanically rotate the pump impeller 28 stages via one or more shafts (not shown) disposed concentrically through the pump protector 16 and the pump intake 14. The shaft mechanically couples the electrical motor 18 to the pump module 12. The pump assembly 10 and components thereof may be disposed within a borehole 24, for example at a natural gas or oil drilling or production site. The pump assembly 10 may also include a pump monitoring unit 20 disposed beneath the electrical motor 18. The pump monitoring unit 20 may include sensors for monitoring the operation of the pump assembly 10, as well as a communications module for transmitting pump data to one or more electronic devices (not shown) located at the surface of the borehole 24 and/or formation.

Referring still to FIG. 1, the pump assembly 10 may also include a power delivery cable electrically coupling the pump assembly 10 to a surface power supply (not shown). In operation, the pump may be used to lift well-fluids to the surface or to transfer fluids from one location to another. The electrical motor 18 provides the mechanical power required to drive the pump module 12 via the shaft. The power delivery cable provides a means of supplying the motor with the needed electrical power from the surface (or from a downhole power supply). The pump protector 16 may aid in absorbing the thrust load from the pump module 12, may transmit power from the electrical motor 18 to the pump module 12, may help to equalize pressure, may help provide and receive additional motor oil as the temperature changes, and may prevent well-fluid from entering the electric motor 18. The pump module 12 may include several stages, each stage being made up of at least one impeller 28 and at least one diffuser. The impellers 28, which rotate during operation, add energy to the fluid to provide head, whereas the diffusers, which are stationary, convert the kinetic energy of the fluid from the impellers 28 into head (that is, hydrostatic pressure). The pump stages may typically be stacked in series to form a multi-stage system that is contained within a pump housing 26. The aggregate or total hydrostatic pressure (that is, "head") generated by each individual stage is cumulative. Therefore, in one or more embodiments, the total head developed by the multi-stage system increases linearly from the first to the last stage. The pump monitoring unit 20 may be installed onto the electric motor 18 to measure parameters such as pump intake and discharge pressures, motor oil and winding temperatures, and vibrations. Measured downhole data may be communicated to the surface via the power cable, which may also act as a communication cable. The components or modules illustrated in the electric submersible pump assembly 10 of FIG. 1 may include other configurations including arrangements in which one or more components are located above or below their respective locations shown in FIG. 1. In addition, the pump module 12 may include more than one pump modules 12 arranged serially.

Figure 2:
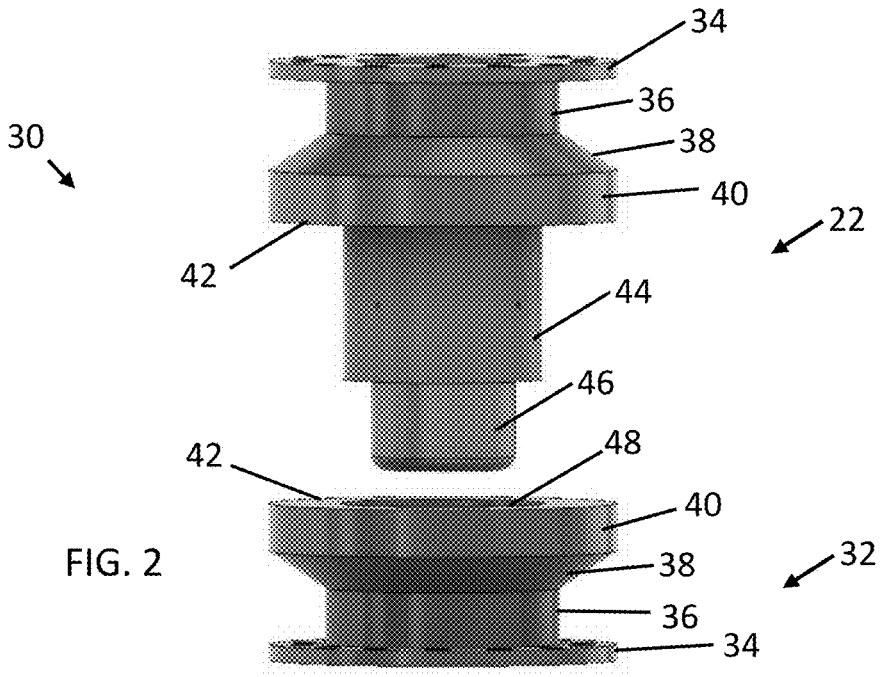
FIG. 2 illustrates a side view of a quick connect apparatus, according to aspects of the present disclosed embodiments.

FIG. 2 illustrates a side view of a quick connect apparatus 30, according to aspects of the present disclosed embodiments. The quick connect apparatus 30 may include both a male component 22, as well as a female component 32. The male component 22 may be sized and shaped such that one or more portions of the male component 22 fit within the female component 32. Each of the male and female components 22, 32 may include a flange 34 at one end, each flange 34 including bolt holes (not shown) for attaching each of the male and female components 22, 32 to an adjacent downhole component. Each of the male and female components 22, 32 may also include an inner portion 36 disposed adjacent to the flange 34, as well as an outer portion 40 disposed on an opposite longitudinal end of inner portion 36 as the flange 34. The inner portion 36 may include a smaller diameter than each of the flange 34 and the outer portion 40, while the flange 34 and the outer portion 40 may include substantially equal diameters (for example, within ten (10) percent of each other). The male and female components 22, 32 may include an angled portion 38 disposed between the inner and outer portions 36, 40. The angled portion 38 may include an increasing or decreasing diameter, thereby forming the transition between the smaller diameter of the inner portion 36 and the larger diameter of the outer portion 40.

Referring still to FIG. 2, the male component 22 may include an outer sleeve 44 extending longitudinally from the mating surface 42. The outer sleeve 44 may be disposed adjacent to the outer portion 40 on an opposite end of the outer portion 40 from the angled portion 38. The outer sleeve 44 may be a cylindrical portion of the male component 22 and may include an outer diameter that is smaller than each of the flange 34, the outer portion 40, and the inner portion 36. A mechanical coupling 46 may be disposed radially inside of a hollow interior or the outer sleeve 44. The mechanical coupling 46 may be used to link two shafts of adjacent pump or drill components, and to transmit mechanical torque between the two adjacent components, as required. For example, the mechanical coupling may rotationally and/or axially couple a first ESP component (for example, an ESP component bolted to the female flange 34) to a second ESP component (for example, an ESP component bolted to the male flange 34). Each of the outer sleeve 44 and the mechanical coupling 46 may be inserted into a female bore 48 (or center bore) disposed in the center of the female component 32. The female component 32 may also include a mating surface 42 such that when the outer sleeve 44 and mechanical coupling 46 are inserted into the female bore 48, the mating surface 42 of the male component 22 comes into contact with the mating surface 42 of the female component 32. The female bore 48 (or center bore) may be longitudinally disposed through the female component 32.

Figure 3:
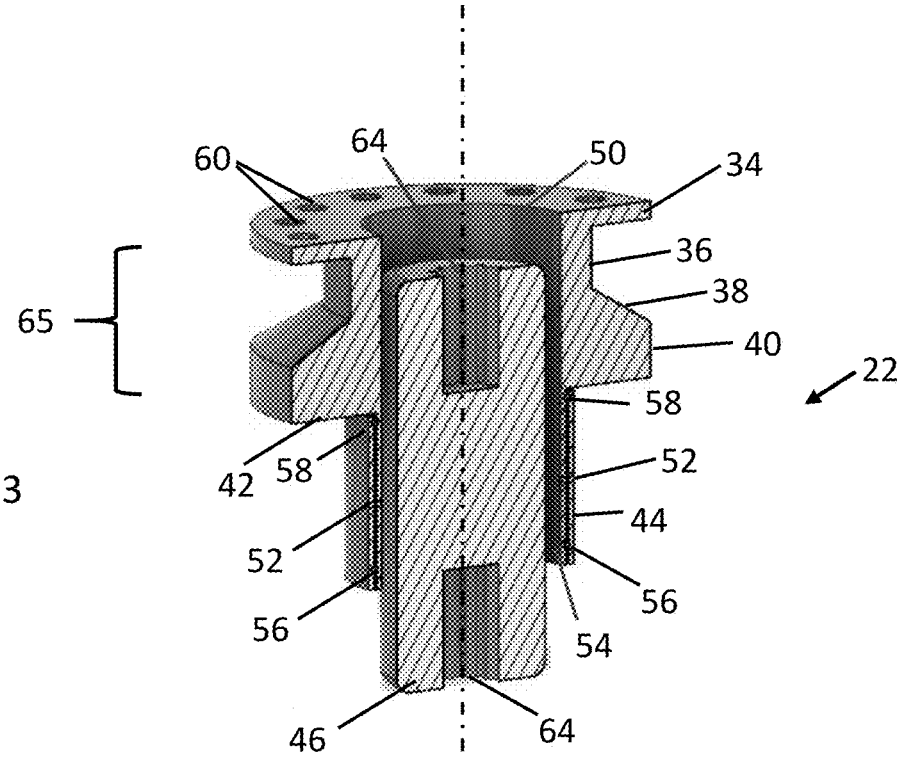
FIG. 3 illustrates a perspective, cross-sectional view of a male component, according to aspects of the present disclosed embodiments.

FIG. 3 illustrates a perspective, cross-sectional view of the male component 22, according to aspects of the present disclosed embodiments. The male component 22 may include the flange 34, the inner portion 36, the angled portion 38, the outer portion 40, the mating surface 42, the outer sleeve 44, and the mechanical coupling 46. In the embodiment of FIG. 3, bolt holes 60 may be disposed through the flange 34. The male component 22 may include from about six (6) to about thirty (30) bolt holes 60 disposed through the flange 34, or from about eight (8) to about twenty (20) bolt holes 60, or from about ten (10) to about sixteen (16) bolt holes 60 or from about twelve (12) to about fourteen (14) bolt holes 60. The flange 34 may also include other numbers of bolt holes 60 disposed therethrough. The male component 22 may also include an inner sleeve 54 coupled to the bottom surface of the outer portion 40 (that is, the mating surface 42) and disposed radially within the outer sleeve 44. A small radial gap may be disposed between the inner and outer sleeves 54, 44. The inner and outer sleeves 54, 44 may be coupled via one or more shear pins 52 extending radially outward from the inner sleeve 54 to the outer sleeve 44. Each of the inner and outer sleeves 54, 44 may be cylindrical and may be approximately the same height. In one embodiment, the shear pins 52 may be located about halfway up the height of the inner and outer sleeves 54, 44. The shear pins 52 may also be circumferentially spaced around the inner and outer sleeves 54, 44. Embodiments according to the present disclosure may include, for example, two (2) shear pins 52 spaced one-hundred and eighty (180) degrees apart, three (3) shear pins 52 spaced one-hundred and twenty (120) degrees apart, four (4) shear pins 52 spaced ninety (90) degrees apart, five (5) shear pins 52 spaced seventy-two (72) degrees apart, six (6) shear pins 52 spaced sixty (60) degrees apart, eight (8) shear pins 52 spaced forty-five (45) degrees apart, and/or ten (10) shear pins 52 spaced thirty-six (36) degrees apart. Other circumferential spacing arrangements of the shear pins 52 are also possible. Axial (that is longitudinal) spacing arrangements of the shear pins 52 are also possible.

Referring still to FIG. 3, the male component 22 may include a first sleeve O-ring 56 (or gasket) extending circumferentially and disposed both radially outward of the inner sleeve 54 as well as radially inward of the outer sleeve 44. Similarly, the male component 22 may also include a second sleeve O-ring 58 (or gasket) extending circumferentially and disposed both radially outward of the inner sleeve 54 as well as radially inward of the outer sleeve 56. In one embodiment, the first sleeve O-ring 56 may be disposed at a first end of the inner and outer sleeves 54, 44 while the second sleeve O-ring 58 may be disposed at a second end of the inner and outer sleeves 54, 44 such that the shear pins 52 are longitudinally disposed between the first and second sleeve O-rings 56, 58. As such, the first and second sleeve O-rings 56, 58 serve to seal the radial gap disposed between the inner and outer sleeves 54, 44. Each longitudinal end of the mechanical coupling 46 may include a star-shaped recess 64 that may match up with complementary splines in mating equipment, thereby allowing the mechanical coupling to transfer rotational energy to, and receive rotational energy from, adjacent components. The mechanical coupling may include recesses that have cross-sectional shapes other than stars such as triangles, squares, hexagons, ellipses, as well as other shapes. The mechanical couplings 46 of the present claimed embodiments may be longer than standard mechanical couplings when the added length of the male component needs to be accounted for when two adjacent downhole components are being coupled. In other embodiments, the recess 64 may include other shapes including (but not limited to) hexagonal, square, triangular, and elliptical shapes, as well as other shapes. The male component 22 may also include a male bore 50 concentrically disposed about a longitudinal centerline 62. Each of the sub-components of the male component 22 (such as the flange 34, the mechanical coupling 46, and the inner and outer sleeves 54, 44) may also be concentrically disposed about the longitudinal centerline 62, which may also act as a centerline to the female component 32.

Figure 4:
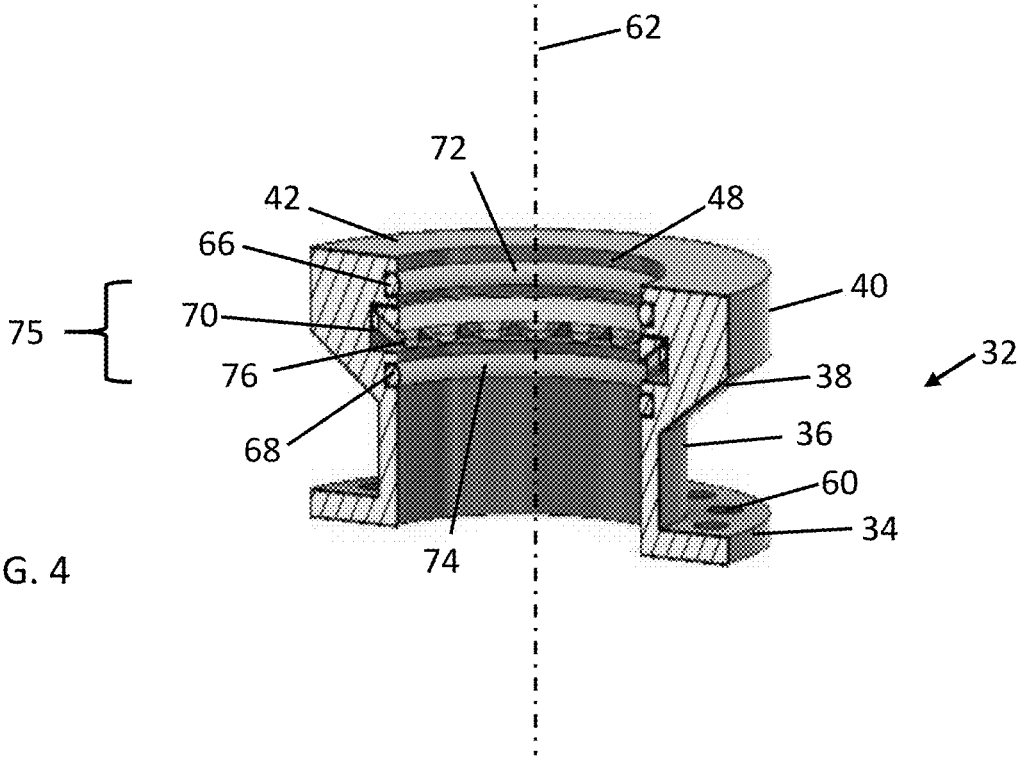
FIG. 4 illustrates a perspective, cross-sectional view of a female component, according to aspects of the present disclosed embodiments.

FIG. 4 illustrates a perspective, cross-sectional view of the female component 32, according to aspects of the present disclosed embodiments. The female component 32 may include the flange 34, the inner portion 36, the angled portion 38, the outer portion 40, the mating surface 42, and a plurality of bolt holes 60. The female component 32 may also include a claw assembly 75 for grasping and tightly attaching to the outer sleeve 44 of the male component 22 when the outer sleeve 44 is inserted into the female bore 48 of the female component 32. The claw assembly 75 may include: a first claw recess 66 disposed proximate to the mating surface 42, a second claw recess 68 disposed proximate to the intersection of the inner portion 36 and the angled portion 38, and a tooth recess 70 disposed proximate to the intersection of the outer portion 40 and the angled portion 38. As such, the tooth recess 70 may be longitudinally disposed between the first and second claw recesses 66, 68. Each of the tooth recess 70 and the first and second claw recesses 66, 68 may be circumferentially disposed around the interior of the female component 32 (that is, circumferentially disposed around the female bore 48). A first claw O-ring 72 may be disposed within the first claw recess 66, while a second claw O-ring 74 may be disposed within the second claw recess 68. Each of the first and second claw O-rings 72, 74 may be used to seal the radial gap or space between the outer sleeve 44 and the interior cylindrical wall of the female component 32, when the male component 22 is inserted into the female bore 48.

Referring still to FIG. 4, the female component 32 may include a plurality of teeth 76 disposed within the tooth recess 70. Each tooth 76 may extend into the female bore 48 such that each tooth 76 engages the outer sleeve 44 of the male component 22 when the male component 22 is inserted into the female component 32. The teeth 76 may flex (for example, due to the elasticity or spring constant of the material with which they are composed) to allow the outer sleeve 44 to be longitudinally inserted into the female bore 48. The teeth 76 may engage one or more grooves, slots, or notches disposed around the outer surface of the outer sleeve 44, thereby preventing the outer sleeve 44 from being withdrawn from the claw assembly 75 once the teeth 76 have engaged one or more recessed features (for example, the grooves, notches, or slots) disposed on the outer surface of the outer sleeve 44. In other embodiments, one or more springs (not shown) may be disposed radially outward of each tooth 76, and radially inward of an inner wall of the tooth recess 70, thereby biasing each tooth 76 into the interior of the female component 32 (that is, within the female bore 48). In operation, the claw assembly 75 engages the outer sleeve 44 when the male component 22 is inserted into the female component 32, without any additional action or steps needing to be taken by the user or operator.

Figure 5:
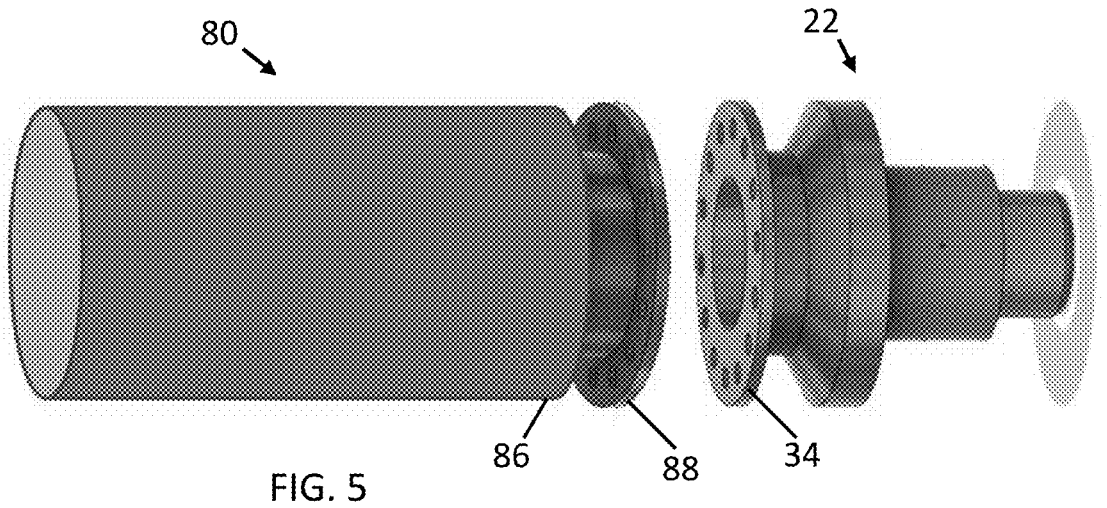
FIG. 5 illustrates a perspective side view of a piping assembly including the male component and a downhole component, according to aspects of the present disclosed embodiments.

FIG. 5 illustrates a perspective side view of a piping assembly including the male component 22 and a pipe or downhole component 80, according to aspects of the present disclosed embodiments. In the embodiment of FIG. 5, a piping component 80 may be bolted to the flange 34 of the male component 22 via a first pipe flange 88 disposed at a first end 86 of the pipe component 80. The pipe component 80 may include a tubular, drill pipe, drill tool, as well as a component of a pump assembly 10 such as a pump module 12, a pump inlet 14, a pump protector 16, a pump electrical motor 18, a pump monitoring unit 20, as well as one or more other downhole components. The male component 22 male be bolted to the piping component 80 (via the flange 34 and first pipe flange 88) while the piping component 80 is at the surface, prior to downhole deployment. The assembly may then be deployed downhole (that is, through the lubricator, not shown), where the assembly may be connected to a drill string or downhole assembly by inserting the male component 22 into a female component 32 of the downhole assembly, without requiring any nuts or bolts to be fastened or unfastened.

Figure 6:
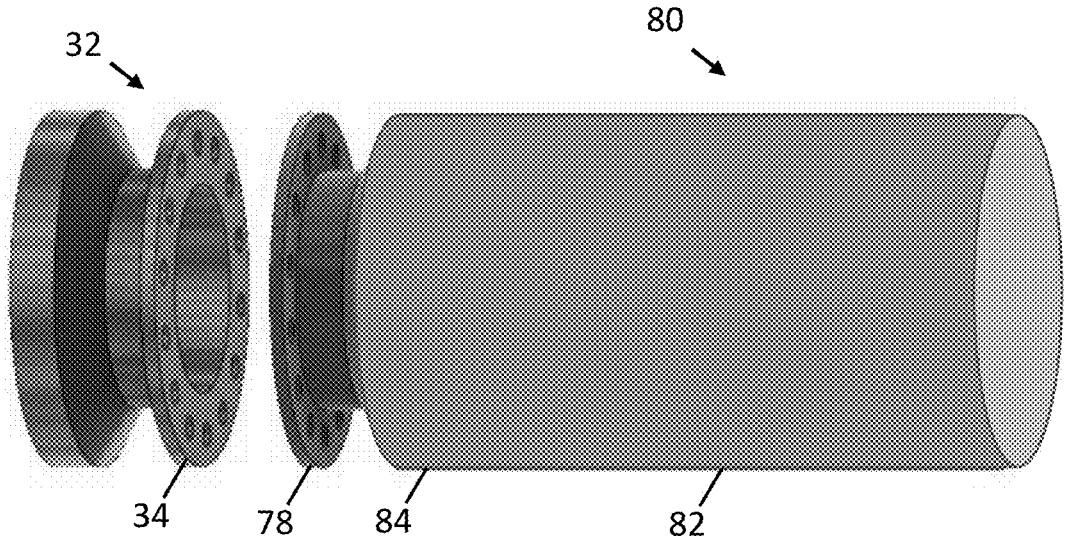
FIG. 6 illustrates a perspective side view of a piping assembly including the female component and a downhole component, according to aspects of the present disclosed embodiments.

FIG. 6 illustrates a perspective side view of a piping assembly including the female component 32 and a pipe or downhole component 80, according to aspects of the present disclosed embodiments. In the embodiment of FIG. 6, the female component 32 may be bolted on to a second end 84 of the pipe component 80 (that is, the opposite end from the first end 86, where the male component 22 of FIG. 5 may be coupled). Similar to the male component 22, the female component 32 may be pre-assembled with the pipe component 80 (via the flange 34 and the second pipe flange 78) while both the pipe component 80 and the female component 32 are at the surface. Once deployed in a downhole environment, the female component 32 may be oriented such that it is at the top of the downhole pipe assembly, positioned to receive the male component 22 of a subsequent tool, drill pipe, tubular, pump component, et cetera, that is deployed downhole.

Figure 7:
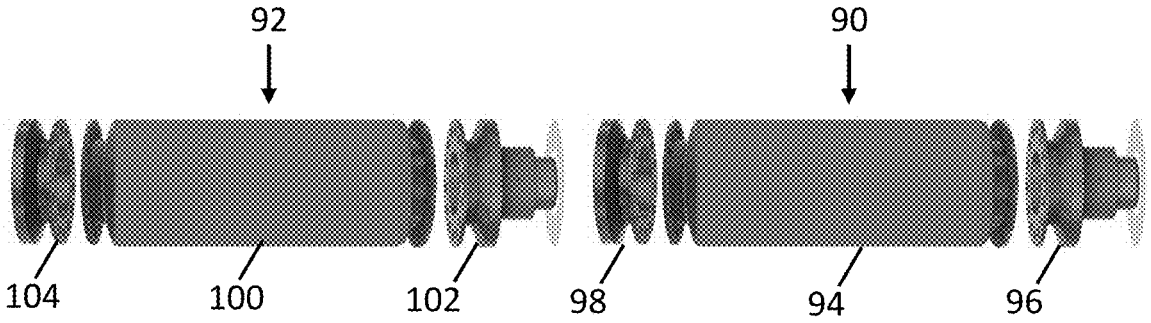
FIG. 7 illustrates a side view schematic of first and second pipe assemblies, according to aspects of the present disclosed embodiments.

FIG. 7 illustrates a side view schematic of first and second pipe assemblies 90, 92, according to aspects of the present disclosed embodiments. The first pipe assembly 90 may include a first pipe component 94 coupled at a first end to a first male component 96 and coupled at a second end to a first female component 98. Similarly, the second pipe assembly 92 may include a second pipe component 100 coupled at a first end to a second male component 102 and coupled at a second end to a second female component 104. In operation, each of the first and second pipe assemblies 90, 92 may be preassembled at the borehole surface. The first pipe assembly 90 may be deployed downhole first with the first male component 96 disposed downwardly to interface with a female component (not shown) already disposed downhole. The first male component 96 may be inserted into the female component already disposed downhole (and coupled to a pump assembly 10 or drill pipe), thereby coupling the first pipe assembly to the downhole assembly. The second pipe assembly 92 may then be deployed downhole by inserting the second male component 102 into the first female component 98, thereby coupling the second pipe assembly 92 to the downhole assembly. The second female component 104 may be disposed at the top of the second pipe assembly 92, ready to receive the male component of a third, fourth, fifth, et cetera pipe assembly (not shown).

Referring to FIGS. 5-7, each of the quick connections that have been made via the present disclosed male and female components 22, 32 may be disconnected by creating an over-pull condition on the drilling string, pump assembly 10, or downhole pipe assembly in which the quick connection is made. For example, by exerting a vertical force on the drilling string, pump assembly 10, or downhole pipe assembly via a slick-line (or other tool in the downhole environment) beyond a predetermined threshold, a shear force acting on the shear pins 52 will cause the shear pins 52 to decouple from the inner sleeve 44, or the outer sleeve 54, or from both the inner and outer sleeves 44, 54, thereby causing the outer sleeve 44 to decouple from the male component 32, which remains engaged and coupled to the female component 32. The remainder of the male component 32 (that is, all of the male component 22 except for the outer sleeve 22) may then be removed from the downhole environment. Stated otherwise, if a large enough upward longitudinal force is exerted on the top of a pump assembly 10 (or other downhole assembly) that includes one or more quick connection systems 30 according to the present embodiments, the shear pins 52 break, shear, and/or otherwise decouple from at least one of the inner and outer sleeves 54, 44, thereby causing the outer sleeve 44 to decouple from the male component 22.

Referring to FIGS. 3-7, the over-pull condition may be created by pulling upwardly on the male component 22 (for example, on the flange 34 of the male component 22, or on a component to which the male component 22 is bolted (via the flange 34)) such that the force is transferred through the inner portion 36, the angled portion 38, and the outer portion 40, into the inner sleeve 54, which is monolithic and integral with a main body 65 of the male component 22. By contrast, the outer sleeve 44 is a separate piece that is coupled to the inner sleeve 54 via the shear pins 52. The force of the female component 32 holding the outer sleeve 44 is greater than the collective force of the shear pins 52 holding the outer sleeve 44 to the inner sleeve 54 such that when the over-pull exerted upwardly on the male component 22 exceeds the shear force of the shear pins 52 holding the outer sleeve 44 to the inner sleeve 54, the inner sleeve 54 (and the rest of the male component 22) detach from the outer sleeve 44 while the outer sleeve 44 remains coupled within the female component 32. Other quick connect segments (for example, the first and second pipe assemblies 90, 92 shown in FIG. 7) may subsequently be detached from a drill string or pump assembly 10 by applying over-pull to the top component of each drill string and/or pump assembly 10. After one or more quick connect segments (for example, the first and second pipe assemblies 90, 92 shown in FIG. 7) have been removed from a drill string or pump assembly 10, segments may be re-added to the drill string or pump assembly 10, this time by disposing a quick connect segment into the downhole environment with the female component 32 face down such that it may engage with the outer sleeve 44 protruding from (and still engaged with) the downhole female component 32. As such, the new female component 32 being added to the drill string or pump assembly 10 may engage an opposite end of the outer sleeve 44 as the female component 32 that is already downhole and engaged on a first end of said outer sleeve 44.

Still referring to FIGS. 5-7, because the flange 34 end of the male and female components 22, 32 of the present embodiments are able to be connected to the pipe components 80, the male and female components 22, 32 may be coupled to any component with a flange while the components are at the surface, while also allowing for quick connections to be made and broken in a downhole environment (via the male and female components 22, 32). As such, the male and female components 22, 32 of the present disclosed quick connect system 30 are adaptable and retrofit-able to any existing flanged components currently in use.

Figure 8:
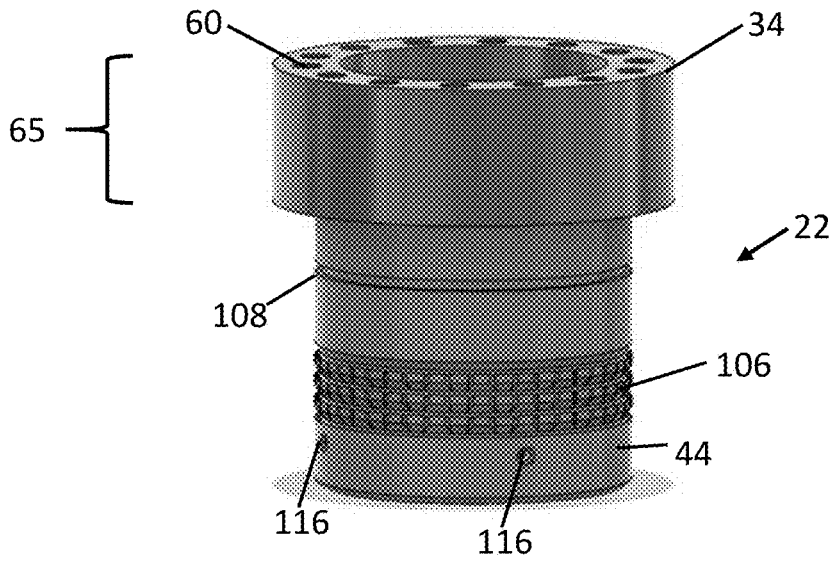
FIG. 8 illustrates a perspective side view of an alternate embodiment of the male component, according to aspects of the present disclosed embodiments.

FIG. 8 illustrates a perspective side view of an alternate embodiment of the male component 22, according to aspects of the present disclosed embodiments. The male component includes the flange 34 (with bolt holes 60 disposed therethrough) as well as the outer sleeve 44. In the embodiment illustrated in FIG. 8, the male component 22 does not include the inner portion 36 or the angled portion 38. Instead, the male component 22 of FIG. 8 includes a main body 65 that is cylindrical or tubular, the main body 65 including a larger outer diameter than the outer sleeve 44. The male component 22 may include a plurality (for example four (4) or six (6), or from about two (2) to about ten (10)) of pin holes 116 circumferentially spaced around the outer circumference of the outer sleeve 44. The pin holes 116 may go all the way through the outer sleeve 44 from the outer surface of the outer sleeve 44 to the inner surface of the outer sleeve 44, thereby allowing shear pins 52 disposed through the pin holes 116 to also engage corresponding anchoring holes 114 (shown in FIG. 9), disposed within the inner sleeve 54. The male component 22 may also include a plurality of engagement features 106 disposed around the outer circumference of the outer sleeve 44, the engagement features being used to engage with the teeth 76 of the female component 32. The male component 22 may also include one or more outer sleeve recesses 108 circumferentially disposed around the outer sleeve 44. One or more O-rings (not shown) or other gaskets may be disposed within the one or more outer sleeve recesses 108 in order to ensure a tight seal of the radial gap between the outer sleeve 44 and the inner surface of the female component 32 when the male component 22 is engaged within the female component 32. The engagement features 106 may be disposed on the outer surface of the outer sleeve 44 longitudinally between the pinholes 116 and the outer sleeve recess 108. In other embodiments, the engagement features 106 may be longitudinally disposed either above or below both the pin holes 116 and the outer sleeve recess 108.

Figure 9:
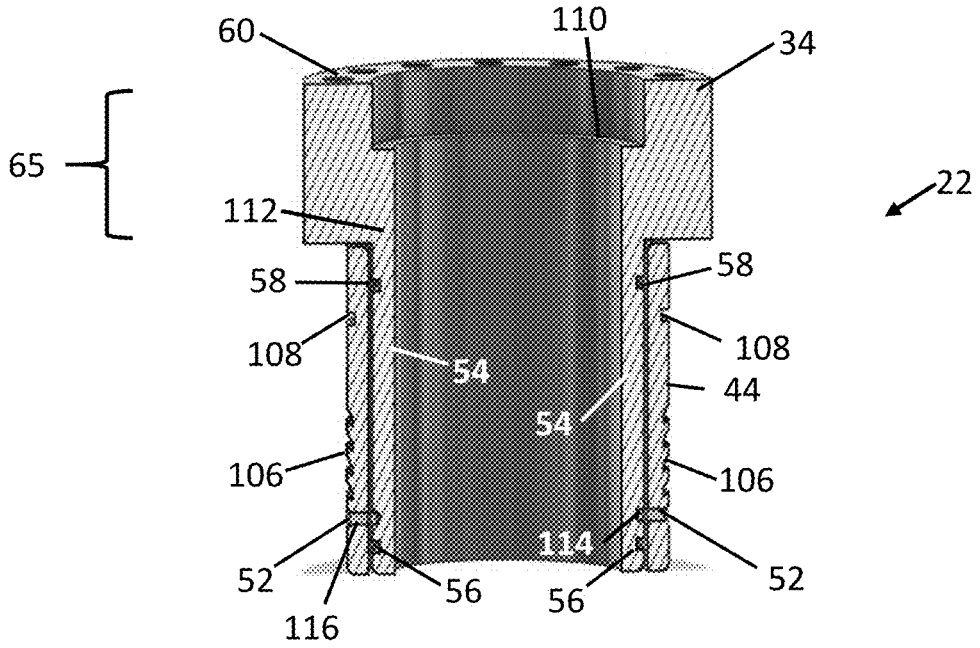
FIG. 9 illustrates a cross-sectional side view of the male component, according to aspects of the present disclosed embodiments.

FIG. 9 illustrates a cross-sectional side view of the male component 22, according to aspects of the present disclosed embodiments. The embodiment of FIG. 9 illustrates a similar male component 22 to the alternate embodiment illustrated in FIG. 8, including the cylindrical main body 65, the flange 34 with bolt holes 60 disposed therein, the outer sleeve 44 with pin holes 116, engagement features 106 and outer sleeve recess 108 disposed therein, as well as the first and second O-ring recesses 56, 58, for sealing the radial gap between the inner and outer sleeves 54, 44. In the embodiment of FIG. 9, the male component 22 may include a circumferential notch 110 disposed around the inner surface of the male component 22. The circumferential notch 110 may be used as a landing area for tools, tubulars, couplings, and/or interfacing or mating components, such that a first bore is disposed at the top of the male component 22, the first bore having a larger diameter than a through-bore of the male component 22, which is disposed longitudinally all the way through the male component 22. The male component 22 may also include one or more shear pins 52 disposed through one or more pin holes 116 within the outer sleeve 44, and anchored within one or more anchor holes 114 disposed within the inner sleeve 54. The male component 22 may also include one or more junction points 112 disposed in the bottom portion of the main body 65 at a radially inner portion of the main body 65. The inner sleeve 54 may extend downwardly from the junction point 112, the inner sleeve 54 being monolithic with and/or integral with the main body (that is, formed as a single, solitary piece). The shear pins 52 may be designed to break or shear off, or alternatively to simply dislodge from the anchor holes 114 when the upward force acting on the inner sleeve 54 (that is, the over-pull) exceeds a predetermined threshold.

Figure 10:
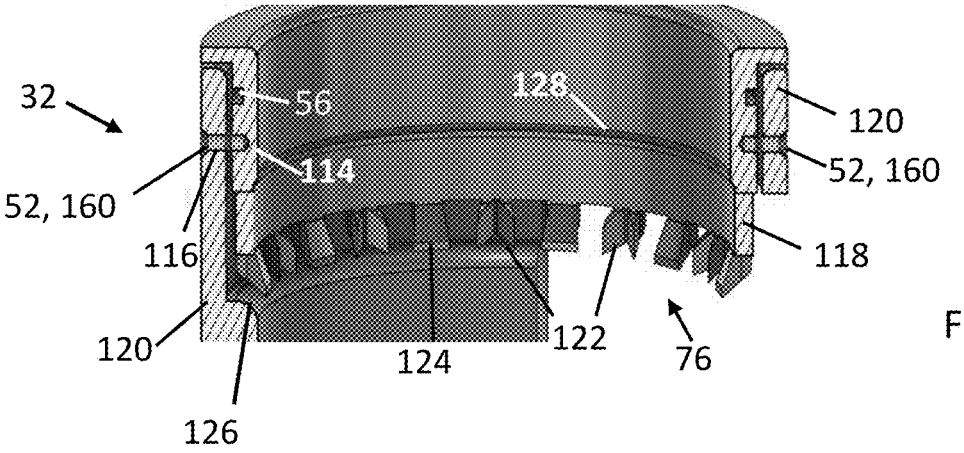
FIG. 10 illustrates a perspective, cross-sectional side view of an alternative embodiment of the female component, according to aspects of the present disclosed embodiments.

FIG. 10 illustrates a perspective, cross-sectional side view of an alternative embodiment of the female component 32, according to aspects of the present disclosed embodiments. In the embodiment of FIG. 10, the female component 32 may include female inner and outer sleeves 118, 120 that are coupled together via shear pins 52 disposed through pin holes 116 disposed in the female outer sleeve 120 and anchor holes 114 disposed in the female inner sleeve 118. As such, the embodiment of FIG. 10 differs from the embodiments of FIGS. 2-9 because in FIG. 10, the disconnection features (that is, the shear pins 52, and concentric female inner and outer sleeves 118, 120) are located on the female component 32 rather than the male component 22. The female component may include a plurality of teeth 76 circumferentially disposed around the female inner sleeve 118. The plurality of teeth 76 may include alternating first and second teeth 122, 124, where each first tooth 122 may include one or more teeth with a longitudinal edge 134 (shown in FIG. 11), and where each second tooth 124 may include one or more teeth with a circumferentially aligned edge 136 (shown in FIG. 11). In the embodiment of FIG. 10, each first tooth 122 may include a doublet arrangement where each doublet includes two adjacent teeth, each with a longitudinal edge 134. Each first tooth 122 or doublet may alternate with each second tooth 124. Other configurations are also possible including two first teeth 122 or doublets for every second tooth 124, two second teeth 124 for every first tooth 122 or doublet, as well as other configurations.

Referring still to FIG. 10, the female component 32 may include multiple circumferential rows of teeth 76 longitudinally disposed above or below the circumferential row of teeth illustrated in FIG. 10. The multiple circumferential rows of teeth may correspond to multiple circumferential rows of engagement features 106 (shown in FIGS. 8, 12, and 14) disposed on the male component 22. The female outer sleeve 120 may include a large internal lip 126 circumferentially disposed around an interior surface of the female outer sleeve. The female inner sleeve 118 may include a small internal lip 128 circumferentially disposed around an interior surface of the female inner sleeve 118. The large internal lip 126 may be larger than (that is, it may span a larger radial distance) than the small internal lip 128. In addition, the large internal lip 126 may include a surface that is oriented longitudinally upwards in the orientation illustrated in FIG. 10 while the small internal lip 128 may include a surface that is oriented longitudinally downwards. As such, the large and small internal lips 126, 128 may include oppositely oriented surfaces. The female inner sleeve 118 may also include at least one recess circumferentially disposed around a radially outer surface of the inner sleeve 118, the recess housing a first O-ring 56 for sealing a radial gap between the female inner and outer sleeves 118, 120. In operation, the female component 32 may include a sleeve, outer sleeve 44 (that is, the outer sleeve 44 of the male component 22), piping component, tubular, drill string, pump component, or other component that may be inserted into the female component 32, where the component is engaged by the teeth 76. When over-pull is applied to the assembly, the shear pins 52 shear off, break, or otherwise disengage the anchor holes 114, thereby allowing the female inner and outer sleeves 118, 120 to decouple.

Referring still to FIG. 10, in one or more embodiments, the female component 32 may include one or more reset bolts 160 in place of the shear pins 52. The reset bolts 160 may be disposed though the female outer sleeve 120 and anchored in the female inner sleeve 118. The reset bolts 120 may be used to retract or disengage the teeth 76 from the outer sleeve 44 (that is, the outer sleeve 44 of the male component 22), thereby allowing the male component 22 to decouple from the female component 32. The reset bolts 160 may typically be used at the surface after both the male and female components 22, 32 have been retrieved or fished out of the borehole and brought back up through the lubricator. By using the reset bolts 160 to disengage the teeth 76 from the outer sleeve 44 of the male component 22, the male and female components 22, 32 may be separated without exerting over-pull on the male component 22, and without causing the shear pins 52 to shear off.

Figure 11:
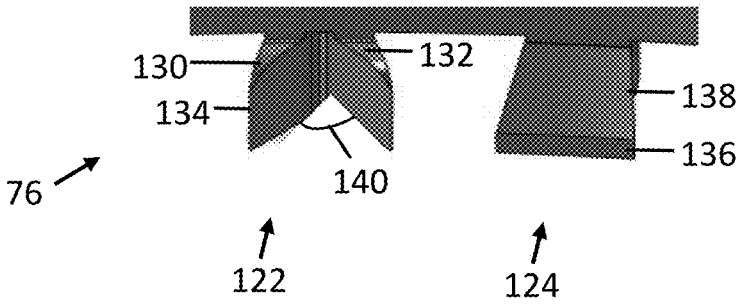
FIG. 11 illustrates a perspective side view of a plurality of teeth, according to aspects of the present disclosed embodiments.

FIG. 11 illustrates a perspective side view of the plurality of teeth 76, according to aspects of the present disclosed embodiments. The first tooth 122 may include a doublet configuration including a first doublet tooth 130 and an adjacent second doublet tooth 132, each of the first and second doublet teeth 130, 132 include a longitudinal edge 134. A first angle 140 may be disposed between the first and second doublet teeth 130, 132. The first angle 140 may be from about one (1) degree to about sixty (60) degrees, or from about ten (10) degrees to about forty-five (45) degrees, or from about fifteen (15) degrees to about thirty-five (35) degrees, or from about twenty (20) degrees to about thirty (30) degrees. The plurality of teeth 76 may include a second tooth 124 disposed adjacent the first tooth 122 or doublet. The second tooth 124 may include an angled surface 138 that angles both longitudinally downward and radially inward. The second tooth 124 may also include a circumferential edge or surface 136.

Figure 12:
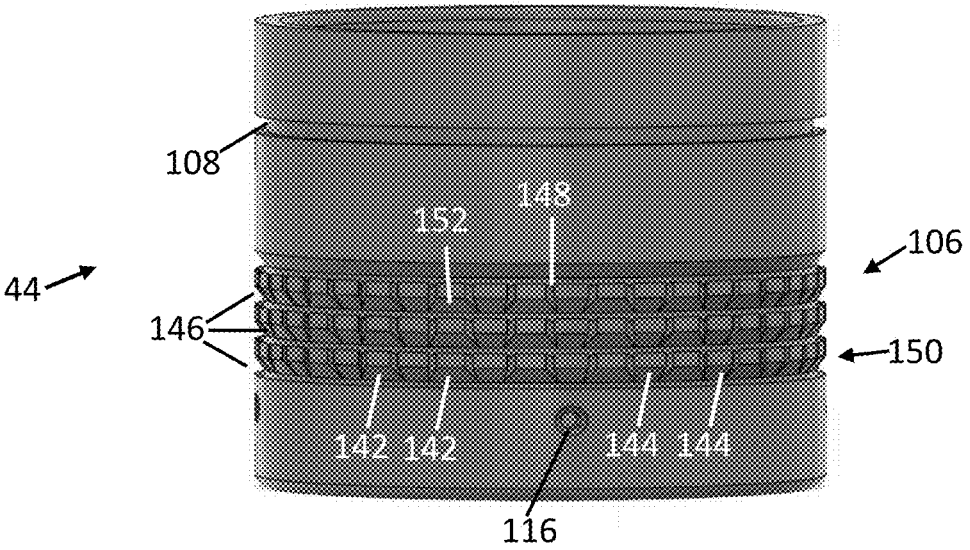
FIG. 12 illustrates a perspective side view of an outer sleeve, according to aspects of the present disclosed embodiments.

FIG. 12 illustrates a perspective side view of an outer sleeve 44, according to aspects of the present disclosed embodiments. The outer sleeve 44 may include an outer sleeve recess 108 circumferentially disposed around the outer surface of the outer sleeve 44, the outer sleeve recess 108 allowing an O-ring or gasket to be disposed therein, thereby sealing a radial gap between the outer sleeve 44 and an internal surface of the female component 32. The outer sleeve 44 may also include one or more pin holes 116 as well as a plurality of engagement features 106. The plurality of engagement features may include one or more circumferential rows 150 of engagement features (for example, three (3) adjacent circumferential rows 150 of features in the embodiment of FIG. 12, and more, less, or the same number of circumferential rows 150 in other embodiments). Each circumferential row 150 may include a plurality of first notches 142 alternating with a plurality of second notches 144. Each of the first notches 142 may include circumferential edges (with angles and dimensions) that match or approximately match the angles and dimensions of each first tooth or doublet 122 such that when the female component 32 engages the outer sleeve 44, the first doublet tooth 130 is aligned adjacent a first circumferential edge of the first notch 142 while the second doublet tooth 132 is aligned adjacent a second circumferential edge of the first notch 142. Each longitudinal edge 134 may then fit in the circumferential gaps 148 disposed between adjacent first and second notches 142, 144.

Referring still to FIG. 12, the outer sleeve 44 may include a longitudinal gap 146 disposed between each circumferential row 150 of engagement features. The circumferential edge 136 of each second tooth 124 may be disposed in the longitudinal gap 146. Each of the first and second notches 142, 144 may also include geometry that approximately matches that of the second tooth 124 with a first surface 152 that angles both radially inward and longitudinally upward or downward (depending on the orientation of the outer sleeve 44). Each of the second teeth 124 as well as the first and second notches 142, 144 also include a top or bottom surface (depending on orientation) that is parallel to a radial plane. As the plurality of first and second doublet teeth 130, 132 engage the plurality of first notches 142, the longitudinal edges 134 engage the circumferential edges of each first notch 142, thereby preventing twisting or relative circumferential motion between the teeth 76 and the outer sleeve 44, and by extension, preventing relative rotational motion between the male and female components 22, 32. Similarly, as the radially planar top and/or bottom surfaces of each of the second teeth 124 engage corresponding top and/or bottom radially planar features of each of the first and second notches 142, 144, relative longitudinal movement between the teeth 76 and the outer sleeve 44 (and by extension, the male and female components) is also prevented. Therefore, the engagement features 106 and teeth 76 collectively prevent both relative longitudinal and circumferential movement of the male and female components 22, 32, once the teeth 76 and engagement features 106 have become engaged with each other.

Figure 13:
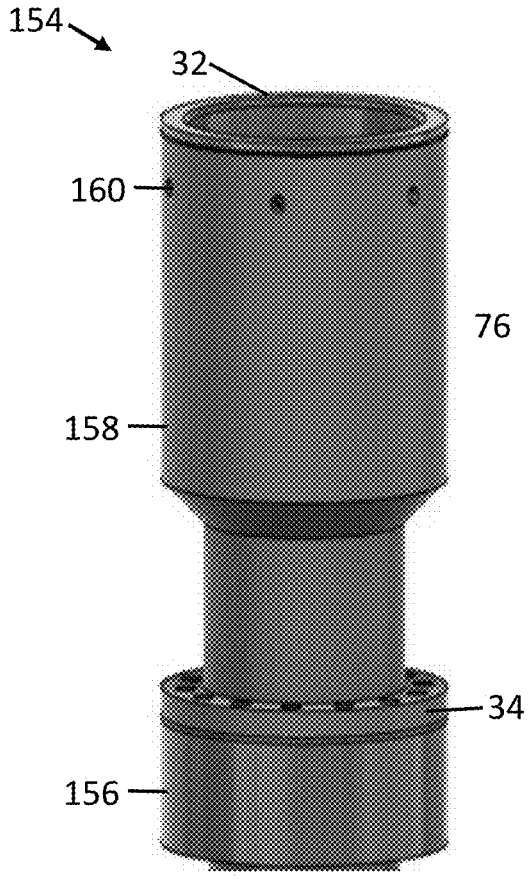
FIG. 13 illustrates a perspective side view of a female sub assembly, according to aspects of the present disclosed embodiments.

FIG. 13 illustrates a perspective side view of a female sub assembly 154, according to aspects of the present disclosed embodiments. The female sub assembly 154 may include a female casing 158 bolted to a pump interface 156 via the flange 34. The female sub assembly 154 may include the female component 32 disposed within the female casing 158 which in turn may include one or more teeth release holes 160, for allowing the teeth 76 (shown in FIGS. 4, 10, and 11) to be released. The one or more teeth release holes 160 may be used to activate (that is via pin or rod) a lever or linkage internal to the female component, which pushes the teeth 76 radially outward, thereby causing the teeth 76 to disengage the engagement features 106 of the outer sleeve. The teeth release holes 160 may be activated at the surface such that the female component 32, the female sub assembly 154, and the outer sleeve 44 may be reused. In other embodiments, reset bolts 160 may be used in place of the release holes 160 to reset the teeth 76 and disengage the outer sleeve 44 from the female component 32. In applications in which the fully assembled quick connect assembly (that is, with the male component 22 engaged within the female component 32) is small enough to fit through the lubricator, the reset bolts 160 may be used to disengage the teeth 76 from the outer sleeve 44, thereby decoupling the male and female components 22, 32, without having to shear off the shear pins 52.

Figure 14:
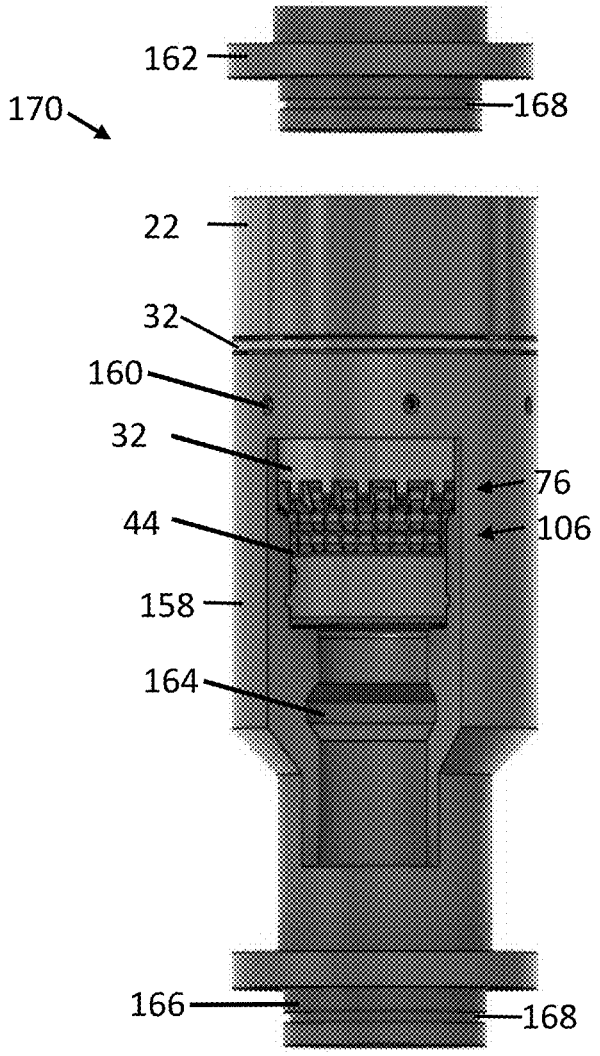
FIG. 14 illustrates a perspective cross-sectional side view of a downhole sub assembly, according to aspects of the present disclosed embodiments.

FIG. 14 illustrates a perspective cross-sectional side view of a downhole sub assembly 170, according to aspects of the present disclosed embodiments. The downhole assembly 170 may include the male component 22 engaged within the female component 32 via the teeth 76 and the engagement features 106, as well as the outer sleeve 44, the female casing 158, and the teeth release features 160. In the embodiment of FIG. 14, the downhole assembly may also include one or more fishing features 164 which includes an increased diameter of at least one portion of at least one component of the female sub assembly 154, thereby allowing the female sub assembly 154 and components thereof to be retrieved (once deployed in a downhole environment) via one or more wirelines, slicklines, or a standard fishing tool (for example, a GS tool). The downhole assembly may also include an electric motor module 162 disposed at the top, as well as a pump module or pump interface 166 disposed at the bottom. Each of the motor module 162 and the pump interface 166 may include at least one circumferential recess 168 for housing an O-ring or gasket used to seal a radial gap between the respective components.

The details of both the teeth 76 and the engagement features 106 illustrated in FIGS. 10-12 may also apply to each of the embodiments of FIGS. 2-9, 13, and 14. In operation, over-pull conditions may not accidentally occur very easily since during normal drilling operations, force is only applied to the drilling string, pump components, and other downhole components in a downward longitudinal direction and/or in a rotational direction, rather than in an upward longitudinal direction. However, if over-pull does occur inadvertently, the top-most quick connect outer sleeve 44 is likely to decouple first (due to added resistance resulting from both the weight of the downhole assembly, as well as the additional fluid pressure, acting on the downhole components located further downhole). The decoupled, top-most component may then be retrieved, brought to the surface, reset, and redeployed downhole using the methods described herein. As such, the decoupling features (that is, the shear pins 52, anchoring holes 114, et cetera) may be designed such that they decouple as intended, without requiring an excessive amount of over-pull. In addition, the teeth release holes 160 may not be accessed accidentally within the confined space available within the borehole casing 24. Each of the teeth 76 and engagement features 106 may be disposed on either the male components 22 or the female components 32. The male and/or female components 22, 32 may include any number of teeth 76 and/or engagement features 106, for example from one (1) to a hundred (100), to hundreds or even thousands of each. Each of the O-rings 56, 58, 66, 68 disclosed herein may be composed of any suitable material including but not limited to HSN, Viton, and Aflas, as well as other suitable materials. In some embodiments, each of the teeth 76 may be composed of a material that is harder than the material of the outer sleeve 44 such that the teeth 76 may "bite into" the outer sleeve 44, thereby grasping the outer sleeve 44 more tightly.

The quick connection system of the present disclosed embodiments enables the possibility of installing and retrieving individual ESP components downhole using alternative deployment methods (for example, wireline or coiled tubing). In turn, the deployment of individual ESP components that automatically connect downhole allows for the possibility of installing long ESP strings using a lubricator in live-well applications, thereby reducing downtime and minimizing the risk of damage that may occur during the process of killing a well (that is, taking the well offline). These long ESP strings may include strings that are longer than those that can fit into the downhole environment through a standard lubricator. The bolted flange connections of the present disclosed embodiments may be made or performed in any controlled environment (for example, at a shop, at the borehole surface, manufacturing plant, et cetera).

At oil rigs, drilling sites, and well sites, the present disclosed embodiments may include methods and systems in which the female component 32 may be deployed downhole using any alternative deployment method (for example, wireline or coiled tubing), with the female component 32 facing upwards. The male component 22 may then be deployed downhole using any alternative deployment method (for example, wireline or coiled tubing), with the male component 22 facing downwards. Each of the male and female components may be coupled to one or more ESP components (that is, via the bolted flange 34). Once the first ESP component reaches the second ESP component, the first ESP component (that is, the component coupled to the male component 32) is slowly lowered until the male component 22 mates with the female component 32. The teeth 76 automatically lock onto and secure the outer sleeve 44 of the male component 22 within the female bore 48. To disengage the first ESP component, any alternative deployment method (that is, wireline or coiled tubing) may be used to engage the first component (that is, the component coupled to the male component 22), and to exert an over-pull force that shears or disengages the shears pins 52, thereby releasing the outer sleeve 44 from the inner sleeve 54, and leaving behind the outer sleeve 44 (which is still engaged within the female component 32 via the teeth 76). The first ESP component becomes free and may then be retrieved to the surface. In other embodiments, the component coupled to the male component 22 may be lowered downhole first and the component coupled to the female component 32 may be lowered down second.

The quick connect system of the present disclosed embodiments provides a means to automatically lock ESP components in live-well, downhole environments, allowing the connection to be used in applications where anchor devices cannot be utilized (because they do not fit through lubricator) or in which the deployment is more complicated (for example, cable deployed ESPs). The present disclosed embodiments may be used to retrofit standard ESP components, and may also be integrated into new products at manufacturing. The quick connect system of the present disclosed embodiments may be deployed in a central wellbore, as well as in horizontal (for example, in connection with coiled tubing) and/or angled tunnels fluidly connecting to the wellbore and/or other passageways. The present disclosed embodiments eliminate the need to kill a well during ESP installation, maintenance, and/or replacement. The present disclosed embodiments allow for safer and more efficient ESP deployments and may be utilized with existing systems and equipment.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, system, or method described herein as "comprising" one or more named elements or steps is open-ended, meaning that the named elements or steps are essential, but other elements or steps may be added within the scope of the apparatus, system, or method. To avoid prolixity, it is also understood that any apparatus, system, or method described as "comprising" (or which "comprises") one or more named elements or steps also describes the corresponding, more limited apparatus system, or method "consisting essentially of" (or which "consists essentially of") the same named elements or steps, meaning that the apparatus, system, or method includes the named essential elements or steps and may also include additional elements or steps that do not materially affect the basic and novel characteristic(s) of the system, apparatus, or method. It is also understood that any apparatus, system, or method described herein as "comprising" or "consisting essentially of" one or more named elements or steps also describes the corresponding, more limited, and closed-ended apparatus, system, or method "consisting of" (or "consists of") the named elements or steps to the exclusion of any other unnamed element or step. In any apparatus, system, or method disclosed herein, known or disclosed equivalents of any named essential element or step may be substituted for that element or step.

As used herein, the term "longitudinally" generally refers to the vertical direction, and may also refer to directions that are co-linear with or parallel to the centerlines of the male and female components. In one or more applications, the male and female components may be rotated (for deployment in horizontal tunnels or boreholes, for example) in which case the longitudinal frame of reference is also rotated. The term "longitudinal" may also be used herein as synonymous with the term "axial." Angles that are defined relative to a longitudinal direction may include both negative and positive angles. For example, a 30-degree angle relative to the longitudinal direction may include both an angle that is rotated clockwise 30 degrees from the vertical direction (that is, a positive 30-degree angle) as well as an angle that is rotated counterclockwise 30 degrees from the vertical direction (that is, a negative 30-degree angle).

As used herein, "a" or "an" with reference to a claim feature means "one or more," or "at least one."

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A quick connect system comprising:

a female component comprising:

a center bore longitudinally disposed therethrough;

a tooth recess disposed around an interior circumference of the center bore; and teeth circumferentially disposed within the tooth recess;

a male component comprising at least one cylindrical portion disposed within the center bore, the at least one cylindrical portion comprising an outer sleeve comprising a plurality of engagement features disposed around an outer circumference of the outer sleeve, the plurality of engagement features interfacing with the teeth; and an inner sleeve concentrically disposed within the outer sleeve, the inner sleeve monolithic with a main body of the male component;

where the teeth engage the at least one cylindrical portion, where a longitudinal over-pull applied to the male component causes the inner sleeve to decouple from the outer sleeve, where the teeth comprise one or more teeth with a longitudinal edge and one or more teeth with a circumferentially-aligned edge, where the teeth prevent relative circumferential and longitudinal motion between the female component and the male component, and where the system is deployed within a downhole environment at a wellsite.

2. The system of claim 1, where the teeth comprise a plurality of first teeth and a plurality of second teeth, where the first teeth and the second teeth are alternatingly arranged within the tooth recess, and where each second tooth of the plurality of second teeth comprises an angled surface that angles both longitudinally downward and radially inward.

3. The system of claim 2, where each first tooth of the plurality of first teeth comprises a doublet comprising a first doublet tooth and a second doublet tooth, and where the over-pull is exerted in a longitudinally upward direction.

4. The system of claim 3, where the first doublet tooth and the second doublet tooth each comprise a longitudinally aligned edge.

5. The system of claim 4, where the first doublet tooth and the second doublet tooth are oriented at a first angle relative to each other, and where the first angle is from about one (1) degree to about sixty (60) degrees.

6. The system of claim 2, where each second tooth of the plurality of second teeth comprises a circumferential edge, and where each second tooth of the plurality of second teeth flexes due to the elasticity of the material with which it is composed to allow the outer sleeve to be longitudinally inserted into the female bore.

7. The system of claim 2, where the plurality of engagement features interface with the plurality of first teeth and the plurality of second teeth.

8. The system of claim 1, further comprising at least one O-ring disposed within at least one O-ring recess circumferentially disposed around the interior circumference of the center bore, where each of the at least one O-ring comprises at least one of HSN, Viton, and Aflas material.

9. The system of claim 8, where the at least one O-ring comprises:

a first O-ring longitudinally spaced from the tooth recess; and a second O-ring longitudinally spaced from the tooth recess and disposed at an opposite longitudinal side of the tooth recess from the first O-ring, where each of the first O-ring and the second O-ring are disposed both radially outward of the inner sleeve and radially inward of the outer sleeve.

10. The system of claim 7, further comprising:

a shear pin coupled to each of the inner sleeve and the outer sleeve, the shear pin disposed within at least one hole disposed within each of the inner sleeve and the outer sleeve, the female component comprising a first flange at a first longitudinal end, the first flange comprising at least one bolt hole disposed therethrough; and the male component comprising a second flange at a second longitudinal end, the second flange comprising at least one bolt hole disposed therethrough, where the longitudinal over-pull applied to the second flange causes the shear pin to shear off, thereby decoupling the outer sleeve from the inner sleeve.

11. The system of claim 10, where the plurality of engagement features comprises:

a plurality of first notches aligned in one or more circumferential rows around the outer circumference of the outer sleeve;

a plurality of second notches aligned in one or more circumferential rows around the outer circumference of the outer sleeve, the plurality of second notches alternating with the plurality of first notches;

at least one longitudinal gap separating the one or more circumferential rows; and at least one circumferential gap separating each first notch from an adjacent second notch, where the teeth and the plurality of engagement features prevent relative longitudinal and circumferential movement between the outer sleeve and the female component.

12. The system of claim 11, where each first tooth of the plurality of first teeth comprises a doublet comprising a first doublet tooth and a second doublet tooth, where the first doublet tooth and the second doublet tooth each comprise a longitudinally aligned edge, where the first doublet tooth and the second doublet tooth are oriented at a first angle relative to each other, and where the first angle is from about one (1) degree to about sixty (60) degrees.

13. A quick connect system for an electric submersible pump (ESP) comprising:

a female component comprising a first flange at one longitudinal end, the first flange comprising at least one bolt hole disposed therethrough, the female component further comprising:

a center bore longitudinally disposed therethrough;

a tooth recess disposed around an interior circumference of the center bore; and teeth circumferentially disposed within the tooth recess;

a male component comprising a second flange at one longitudinal end, the second flange comprising at least one bolt hole disposed therethrough, the male component comprising at least one cylindrical portion disposed within the center bore, a first ESP component coupled to the female component via the first flange;

a second ESP component coupled to the male component via the second flange; and a mechanical coupling concentrically disposed within the female component and the male component, where the teeth engage the at least one cylindrical portion, where the mechanical coupling couples the first ESP component to the second ESP component, where the first ESP component comprises at least one centrifugal impeller, and where the system is deployed within a downhole environment at a wellsite.

14. The system of claim 13, where the second ESP component comprises at least one of a pump protector and a pump monitoring unit.

15. A method of assembling a system in a downhole environment at a wellsite comprising:

providing a female component in a downhole environment, the female component coupled to a first component of the system, the female component comprising a center bore longitudinally disposed therethrough, the female component comprising teeth disposed within an interior surface of the female component;

deploying a male component into the downhole environment via at least one lubricator disposed in a borehole, the male component comprising a cylinder portion;

inserting the cylinder portion into the center bore, thereby causing the teeth to engage the cylinder portion; and engaging one or more reset bolts causing the teeth to disengage the cylinder portion, thereby decoupling the male component from the female component, where the teeth comprise one or more teeth with a longitudinal edge and one or more teeth with a circumferentially-aligned edge, and where the teeth prevent relative circumferential and longitudinal motion between the female component and the male component.

16. The method of claim 15, further comprising coupling a second component of the system to the male component prior to deploying the male component in the downhole environment.

17. The method of claim 16, further comprising exerting a longitudinal over-pull force on the male component, where the cylinder portion is coupled to an inner sleeve extending from a main body of the male component via from about two (2) to about ten (10) shear pins spaced circumferentially around the inner sleeve, and where the about two (2) to about ten (10) shear pins shear off as a result of the longitudinal over-pull force, thereby decoupling the cylinder portion from the male component.

18. The method of claim 17, further comprising fishing the male component out of the downhole environment after decoupling the cylinder portion from the male component.

19. The method of claim 16, further comprising:

fishing both the female component and the male component out of the downhole environment.

* * * * *